United States Patent [19]

Palgrave

[11] Patent Number: 5,076,758

[45] Date of Patent: Dec. 31, 1991

[54] CENTRIFUGAL PUMPS

[75] Inventor: Ronald Palgrave, Marley Hill, England

[73] Assignee: Ingersoll-Rand Company, Woodcliff Lake, N.J.

[21] Appl. No.: 553,645

[22] Filed: Jul. 18, 1990

[51] Int. Cl.[5] ..... F04D 29/00

[52] U.S. Cl. ..... 415/214.10; 415/196; 415/912

[58] Field of Search ..... 415/182.1, 196, 197, 415/203, 214.1, 912, 206

[56] References Cited

U.S. PATENT DOCUMENTS

| | | | |
|---|---|---|---|
| 2,636,442 | 4/1953 | Roth | 415/203 |
| 3.091,182 | 5/1963 | Anderson et al. . | |
| 3,188,966 | 6/1965 | Tetlow | 415/196 |
| 3,543,368 | 12/1970 | Marlow . | |
| 4,178,131 | 12/1979 | Sieghartner | 415/912 |
| 4,676,717 | 6/1987 | Willyard, Jr. et al. . | |

FOREIGN PATENT DOCUMENTS

| | | | |
|---|---|---|---|
| 81456 | 6/1983 | European Pat. Off. | 415/206 |
| 863361 | 3/1961 | United Kingdom | 415/DIG. 3 |

*Primary Examiner*—Edward K. Look
*Assistant Examiner*—James A. Larson
*Attorney, Agent, or Firm*—David W. Tibbott; James R. Bell

[57] ABSTRACT

A centrifugal pump including a cup-shaped housing closed by a casing cover having inlet and outlet ports and enclosing a pump impeller mounted on a shaft driven by an external driver. The centrifugal pump impeller discharges fluid into a helical passage as it travels from the periphery of the impeller to the discharge port and with the passage being confined to a cylindrical envelope extending axially relative to the impeller and slightly larger than the periphery of the impeller. The helical passage is defined by a part of the pump housing that is separate from the main portion of the housing.

3 Claims, 3 Drawing Sheets

CENTRIFUGAL PUMPS

BACKGROUND OF THE INVENTION

This invention relates generally to a centrifugal pump and more particularly to a new design of housing for a centrifugal pump.

Prior art centrifugal pumps use either a volute shaped collector housing or a multivaned diffuser for converting the velocity (kinetic energy) of the pumped fluid leaving the periphery of the pump impeller to pressure (potential energy) prior to discharge from the pump. Generally the volute shaped housing forms a passage surrounding the impeller and having a cross-sectional area that continuously increases as the pumped fluid flows from the periphery of the impeller to the discharge port in the pump housing. The shape and size of the volute passage in the pump housing cannot be easily changed without changing the housing and changes in the pump housing usually are difficult and expensive because pump housings are usually castings. On the other hand it is frequently desirable to change the size and or shape of the volute passage to provide the pump with different pump characteristics in order for a pump to meet individual applications. Another disadvantage to using a volute type of pump housing is that it substantially increases the maximum diametrical size of the pump housing compared to the diameter of the impeller.

The foregoing illustrates limitations existing in presently known centrifugal pumps. It is apparent that it would be advantageous to provide an alternative centrifugal pump directed to overcoming one or more of the limitations set forth above. Accordingly, a suitable alternative is provided including features more fully disclosed hereinafter.

SUMMARY OF THE INVENTION

This invention allows the collector passage at its conventional location surrounding the periphery of the pump impeller to progressively expand in a direction parallel to the axis of the impeller, rather than in a radial direction. This new arrangement of collector passage substantially reduces the maximum diametrical measurement of the pump housing. Furthermore it enables the walls of the passage to be made in a separate concentric body that can be inserted into the main pump housing. The separate part of the housing containing the collector passage can be replaced to change the characteristics of the pump without changing the main housing of the pump.

The foregoing and other aspects of the invention will become apparent from the following detailed description of the invention when considered in conjunction with the accompanying drawing figures. It is to be expressly understood, however, that the drawing figures are not intended as a limitation of the invention but are for the purpose of illustration only.

DETAILED DESCRIPTION

Figure 1:
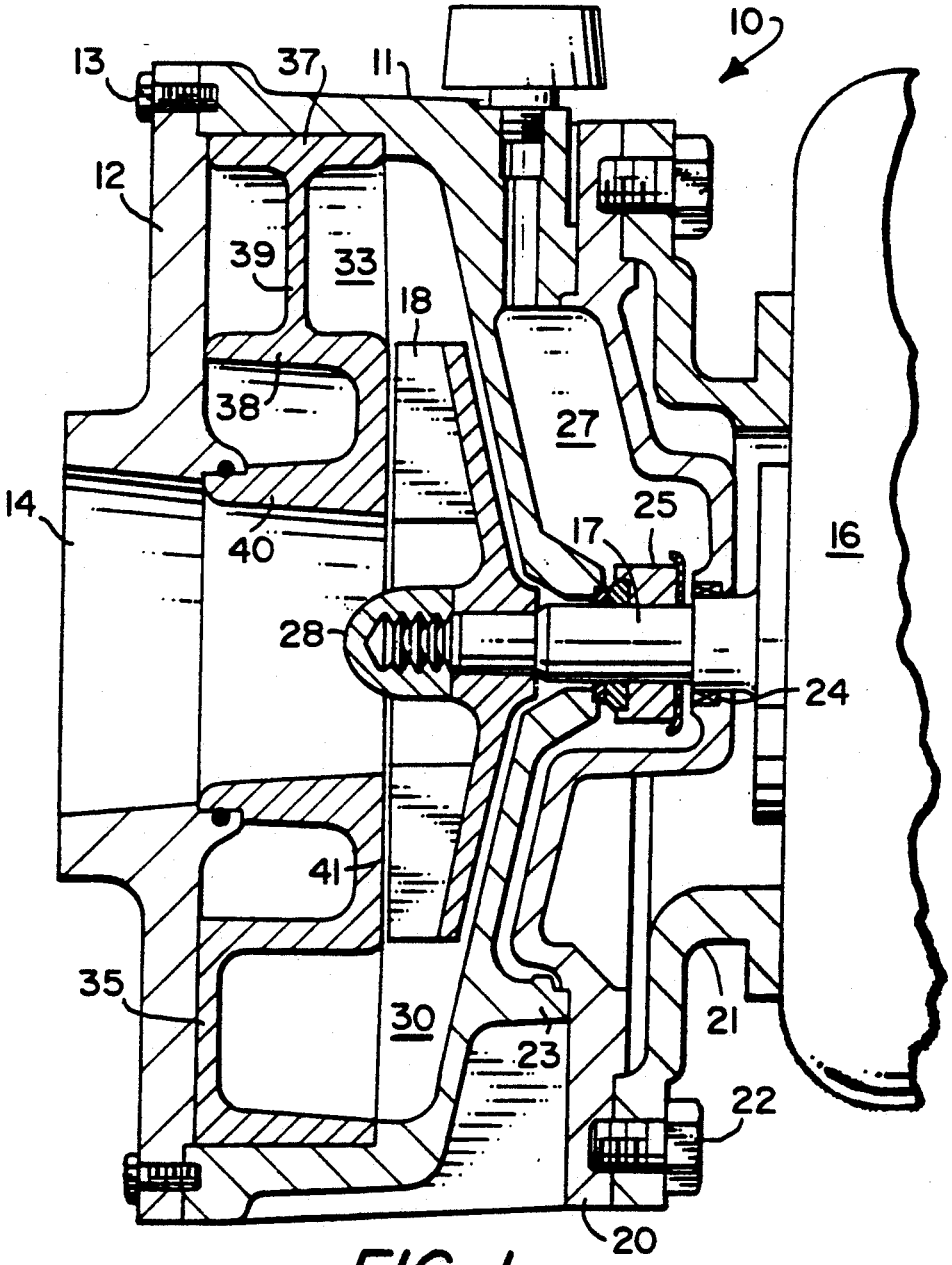
FIG. 1 is an axial section of an embodiment of a centrifugal pump incorporating the principals of this invention.
Figure 2:
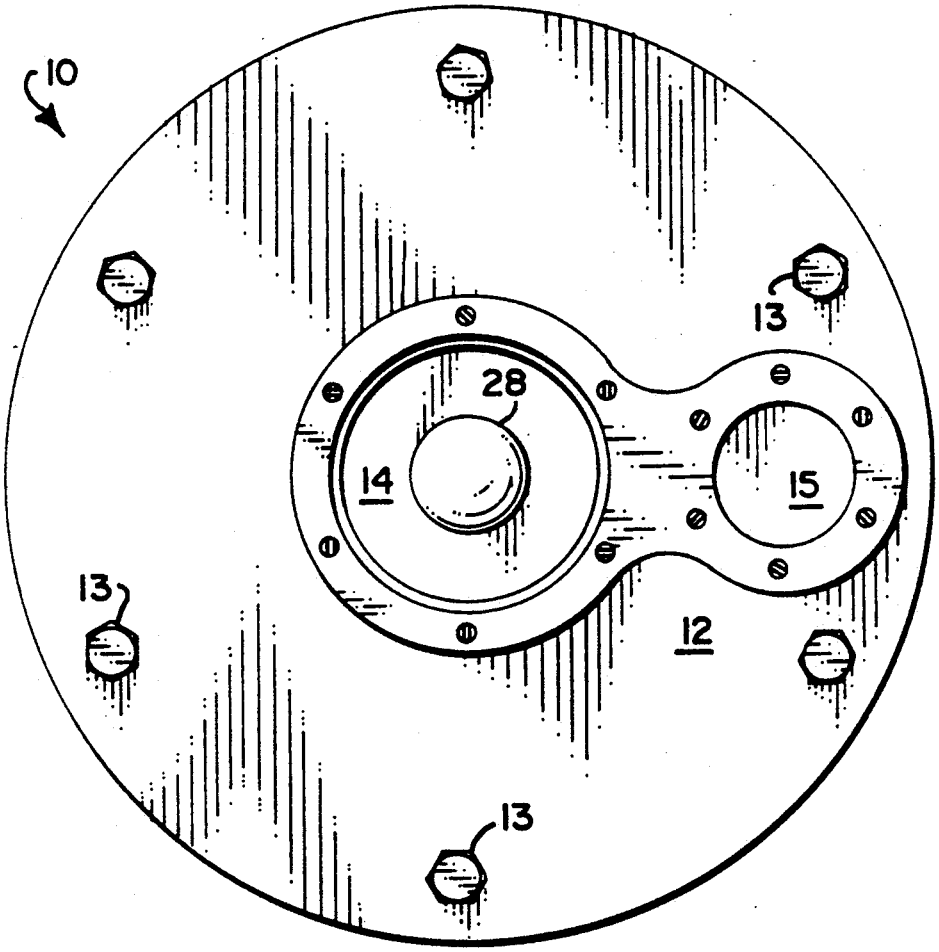
FIG. 2 is a vertical view of the pump of FIG. 1 taken from the end of the pump opposite the driven end.

The centrifugal pump 10 shown in the drawings includes a cup-shaped housing 11 closed by a casing cover 12 attached to the housing 11 by bolts 13. The casing cover 12 has an inlet port 14 and an outlet port 15. The pump is driven by a driver 16, for example, an internal combustion engine, attached to the pump shaft 17 which in turn is connected to the pump impeller 18 located inside of the housing 11.

A seal plate 20 is mounted on the shaft end of the housing 11 and the driver 16 is mounted on the seal plate 20 by a circular support 21. The circular support 21 is attached to the seal plate by bolts 22 and the driver 16 is attached to the circular support 21 by means such as welding, for example. The seal plate 20 is seated on corresponding shoulders 23 formed on the housing 11 and attached to the housing 11 by conventional means. The seal plate 20 includes a seal 24 circling the shaft 17. A face seal 25 is located between the shaft 17 and the opening in the housing 11 where the shaft 17 passes through the housing 11 to control the leakage from inside the housing through the shaft opening into the space 27 located between the housing 11 and the seal plate 20.

The inner end of the shaft 17 is attached to the impeller 18 by a conventional key and keyway, not shown in the drawings, and a nut 28 threaded on the end of the shaft 17. The impeller 18 rotates in the pump chamber 30 and fluid flows into the pump through the inlet 14, pass the nut 28 and into the blades of the impeller 18 where it is pumped centrifugally outward and into the peripheral pumping chamber 30, all in the manner of a conventional centrifugal pump. At this point the fluid has a large velocity and some means must be used to reduce the velocity and turn the velocity of the fluid into potential energy. Conversion of the pumped fluid is usually done by a volute collector which is a scroll like passage formed around the periphery of the impeller 18 and having a passage that increases in cross-section progressively as the fluid flows along the collector which acts to slow the fluid down and to change it into high pressure fluid.

Figure 3:
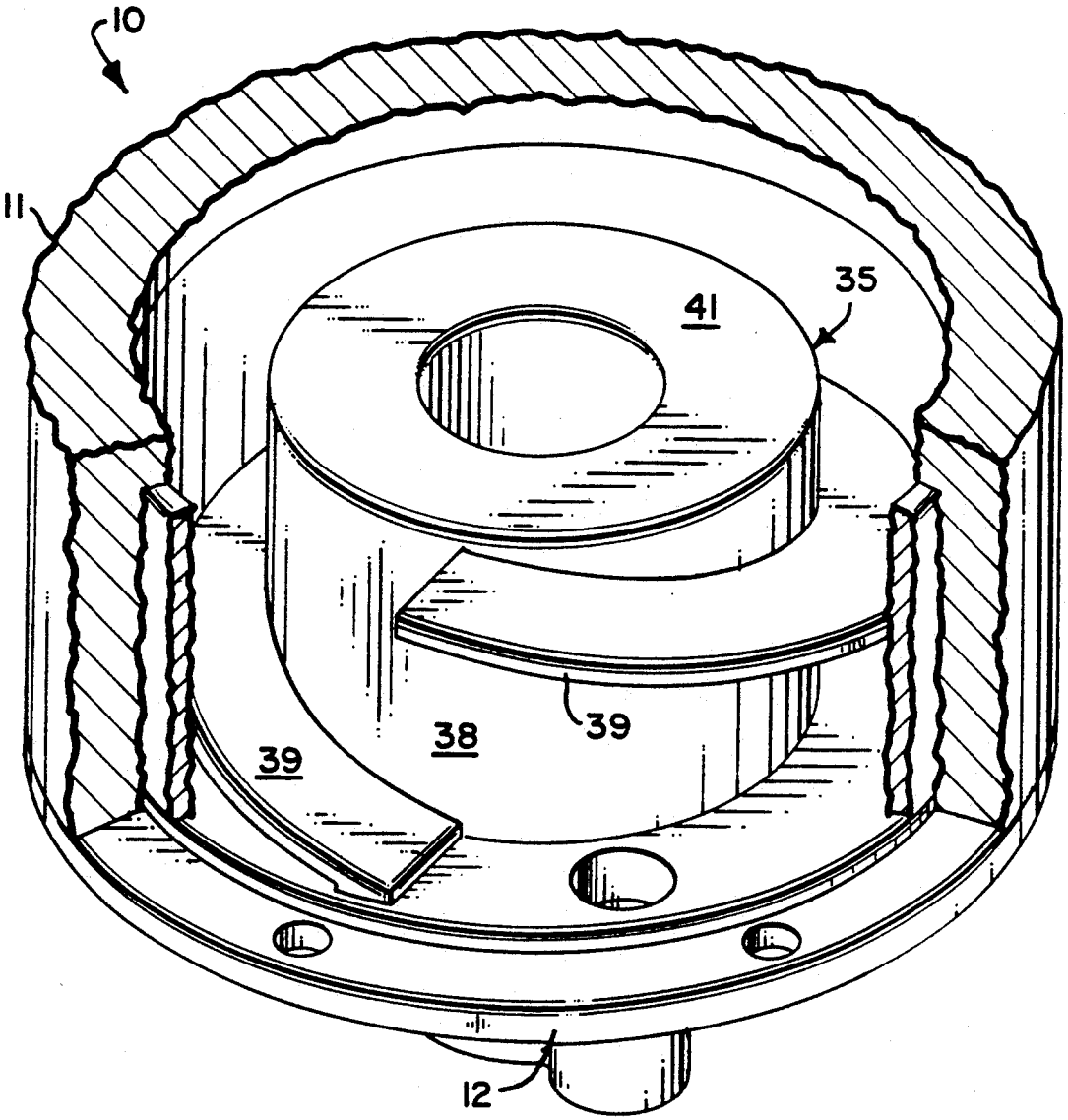
FIG. 3 is a perspective view of the insert that goes in the casing and forms the discharge passage of the pump.

In the present case the invention does away with the conventional volute and uses a passage 33 which is located adjacent to the pumping chamber and axially forward of it. The progressively expanding passage 33 is formed by an insert 35 which is separate from the pump housing 11 and is held in place by the housing 11 and the casing cover 12. The insert 35 is circular, as shown in FIG. 3, and is composed of an outer circular wall 37, an intermediate circular wall 38 and a lateral wall 39 extending between the walls 37 and 38, generally at right angles to such walls, as shown in FIG. 1. In addition, the lateral wall 39 moves progressively forward in an axially direction as it extends angularly around the insert 35 so that at one point it is close to the side of the insert 35 adjacent the impeller 18 and at another point it is close to the side of the insert 35 opposite the impeller side.

The insert 35 further has an inner circular wall 40 which forms a part of the fluid inlet 14 and is joined to the intermediate wall 38 by an integral face wall 41 that extends angularly around the inlet opening of the insert 35 and serves to join the inner wall 40 to the intermediate wall 38.

The inner face of the insert 35 serves as a face wall for the pumping chamber 30. In addition, since the insert 35 is separate from the housing, it can be readily changed to change the characteristics of the pump so that the pump can be made to cover a wider range of capacity and flow rates without the need for a change in the housing 11. The only changes that need to be made will be in the insert 35.

While this invention has been illustrated and described in accordance with a preferred embodiment, it is recognized that variations and changes may be made therein without departing from the invention as set forth in the claims.

Having claimed the invention, what is claimed is:

1. A centrifugal pump comprising:

a housing having an inlet port and a discharge port, and enclosing a pumping chamber;

a pump impeller mounted on a shaft rotatably mounted in said housing;

a pump discharge body containing a pump discharge passage arranged to receive pumped fluid discharged from the impeller and to conduct said pumped fluid along a helical path that is confined substantially within a cylindrical envelope surrounding the periphery of said impeller and to discharge said pumped fluid through said discharge port;

said pump discharge body being a separate part of the pump that can be removed by opening said housing; and said body being concentric with said impeller and including radially spaced cylindrical inner and outer walls connected by an axially spiralling wall cooperating with said inner and outer walls to form said helical path.

2. The centrifugal pump of claim 1 wherein said passage progressively expands in cross-section as it extends from the impeller to the discharge port.

3. The centrifugal pump of claim 2 wherein the expansion of cross-section of said passage takes place in an axial direction relative to said impeller.

* * * * *